US009217991B2

(12) United States Patent
Tsutsumi

(10) Patent No.: US 9,217,991 B2
(45) Date of Patent: Dec. 22, 2015

(54) IMAGE FORMING APPARATUS

(71) Applicant: KYOCERA Document Solutions Inc., Osaka (JP)

(72) Inventor: Masahiro Tsutsumi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/260,081

(22) Filed: Apr. 23, 2014

(65) Prior Publication Data

US 2014/0321868 A1 Oct. 30, 2014

(30) Foreign Application Priority Data

Apr. 26, 2013 (JP) ..... 2013-094663

(51) Int. Cl.

| | |
|---|---|
| ***G03G 21/20*** | (2006.01) |
| *G03G 15/02* | (2006.01) |
| *G03G 15/16* | (2006.01) |
| *G03G 15/00* | (2006.01) |

(52) U.S. Cl.

CPC ..... *G03G 21/206* (2013.01); *G03G 15/0266* (2013.01); *G03G 15/1675* (2013.01); *G03G 15/5033* (2013.01); *G03G 2215/00084* (2013.01)

(58) Field of Classification Search

CPC ..... G03G 21/20
USPC ..... 399/44
See application file for complete search history.

(56) References Cited

U.S. PATENT DOCUMENTS

| | | | | |
|---|---|---|---|---|
| 5,206,754 | A * | 4/1993 | Yano et al. | 359/196.1 |
| 6,621,554 | B1 * | 9/2003 | Ayash et al. | 355/30 |
| 7,447,730 | B2 * | 11/2008 | Iguchi et al. | 709/201 |
| 2002/0025180 | A1 * | 2/2002 | Kimizuka et al. | 399/92 |
| 2009/0136242 | A1 * | 5/2009 | Okamoto et al. | 399/13 |
| 2010/0247123 | A1 * | 9/2010 | Honjoh et al. | 399/44 |
| 2010/0254721 | A1 * | 10/2010 | Fukita et al. | 399/44 |
| 2013/0223860 | A1 * | 8/2013 | Yasumoto | 399/44 |
| 2013/0251385 | A1 * | 9/2013 | Mitourida | 399/44 |
| 2014/0321868 | A1 * | 10/2014 | Tsutsumi | 399/44 |

FOREIGN PATENT DOCUMENTS

| | | | | |
|---|---|---|---|---|
| JP | 2007-232428 | A | 9/2007 | |
| JP | 2009-271237 | * | 11/2009 | G03G 21/20 |

OTHER PUBLICATIONS

Notice of Rejection mailed by Japan Patent Office on Jul. 21, 2015 in the corresponding Japanese patent application No. 2013-094663—4 pages.

* cited by examiner

*Primary Examiner* — Clayton E Labelle
*Assistant Examiner* — Kevin Butler
(74) *Attorney, Agent, or Firm* — Knobbe, Martens Olson & Bear LLP

(57) ABSTRACT

A multifunction peripheral includes: an apparatus body including an intake opening through which external air is taken in; an axial flow fan configured to send air through the intake opening to an interior of the apparatus body; and a substrate including a temperature sensor placed on one surface thereof facing a first air flow path formed by activation of the blower and a humidity sensor placed on the other surface thereof facing a second air flow path along which a smaller amount of air flow flows than along the first air flow path.

17 Claims, 8 Drawing Sheets

Fig.5

| ΔT | HUMIDITY CORRECTION VALUE Δh |
|---|---|
| $1 \leqq \Delta T < 2$ | 10 |
| $2 \leqq \Delta T < 3$ | 15 |
| $3 \leqq \Delta T < 4$ | 20 |
| $4 \leqq \Delta T$ | 25 |

Fig.6

Unit μA

| | | HUMIDITY Hs[%] | | | | |
|---|---|---|---|---|---|---|
| | | Hs < 25 | 25 ≦ Hs < 45 | 45 ≦ Hs < 65 | 65 ≦ Hs < 85 | 85 ≦ Hs |
| TEMPERATURE Ts [°C] | 50 ≦ Ts | 8 | 10 | 12 | 13 | 15 |
| | 40 ≦ Ts < 50 | 7.5 | 9.5 | 11 | 12 | 14 |
| | 30 ≦ Ts < 40 | 7 | 9 | 10.5 | 11.5 | 13.5 |
| | 20 ≦ Ts < 30 | 7 | 9 | 10 | 11 | 13 |
| | 10 ≦ Ts < 20 | 7 | 8.5 | 9.5 | 10.5 | 12.5 |
| | 0 ≦ Ts < 10 | 6.5 | 8.5 | 9 | 10 | 12 |
| | Ts < 0 | 6 | 8 | 8.5 | 9.5 | 11.5 |

IMAGE FORMING APPARATUS

INCORPORATION BY REFERENCE

This application claims priority to Japanese Patent Application No. 2013-094663 filed on Apr. 26, 2013, the entire contents of which are incorporated by reference herein.

BACKGROUND

The present disclosure relates to image forming apparatuses.

In image forming apparatuses, such as a copier and a printer, configured to form an image by electrophotography, an image is formed on a sheet through a specified electrophotographic process. In this electrophotographic process, the surface of an image carrier, such as an organic photosensitive drum, is charged with electricity by applying a voltage to a contact charging member, such as a charging roller, in contact with the image carrier, the charged image carrier is exposed to image-bearing laser light to form an electrostatic latent image, and the electrostatic latent image is developed with a developer toner by a developing device and thus formed into a toner image.

The toner image is transferred to a recording medium, such as a paper sheet, or an intermediate transfer member, a photosensitive layer on the surface of the image carrier after being subjected to the transfer process is cleaned by a cleaning blade, residual charge on the photosensitive layer is removed by optical static elimination, and then the process returns to the charging step. This process cycle is repeated. Meanwhile, the recording medium having the toner image transferred thereto passes through a fixing unit including a roller heated to a predetermined temperature to fix the toner image on the surface thereof and is then discharged to the outside of the image forming apparatus.

Generally, the optimal setting values for process conditions (a charging bias condition, a transfer bias condition, a development bias condition, fixing control, and so on) during image formation vary depending upon the temperature, humidity, and so on in the surrounding environment. For example, under high-temperature environment, the transfer performance decreases owing to moisture adsorption of the paper. Therefore, to secure the transferability, the transfer voltage applied needs to be increased. For another example, organic photoconductors generally change the ability to be charged depending upon the temperature. Therefore, to maintain a constant charged potential of such a photoconductor independent of the temperature, the charging bias applied needs to be changed according to the temperature.

To solve the above problems, a large number of techniques are disclosed in which a temperature sensor and a humidity sensor are provided in the interior of an image forming apparatus and the conditions for the image forming process are changed based on detection results of these sensors. In a general image forming apparatus, external air is introduced thereinto via a fan or the like for the purpose of cooling the image forming section and the temperature and humidity sensors are exposed to the external air having passed through the fan or the like to increase the response of the detected values.

There is also known a technique in which a substrate having one surface with a temperature sensor placed thereon and the other surface with a humidity sensor placed thereon is disposed at an intake opening in a sirocco fan so that intake air is allowed to flow in parallel flows over the one and the other surfaces of the substrate. With this technique, the distance from the intake opening to the temperature sensor can be equal to the distance from the intake opening to the humidity sensor. Thus, the temperature sensor and the humidity sensor can detect the external air flows in the same conditions, resulting in further reduced reading errors between the sensors.

SUMMARY

A technique improved over the above techniques is proposed as one aspect of the present disclosure.

An image forming apparatus according to one aspect of the present disclosure includes an apparatus body, a blower, and a substrate.

The apparatus body includes an intake opening through which external air is taken in.

The blower is configured to send air through the intake opening to an interior of the apparatus body.

The substrate includes a temperature sensor placed on one surface thereof facing a first air flow path formed by activation of the blower and a humidity sensor placed on the other surface thereof facing a second air flow path along which a smaller amount of air flow flows than along the first air flow path.

BRIEF DESCRIPTION OF THE DRAWINGS

FIG. 5 is a correction table showing humidity correction values ($\Delta h$) versus temperature change ($\Delta T$) in the one embodiment of the present disclosure.

FIG. 6 is a correction table showing transfer output values versus temperature (Ts) and humidity (Hs) in the one embodiment of the present disclosure.

DETAILED DESCRIPTION

A description will be given below of one embodiment of the present disclosure with reference to the drawings. The following description is given by taking, as an example of an image forming apparatus according to the present disclosure, a multifunction peripheral combining multiple functions, including a copier, a printer, and a facsimile machine.

Figure 1:
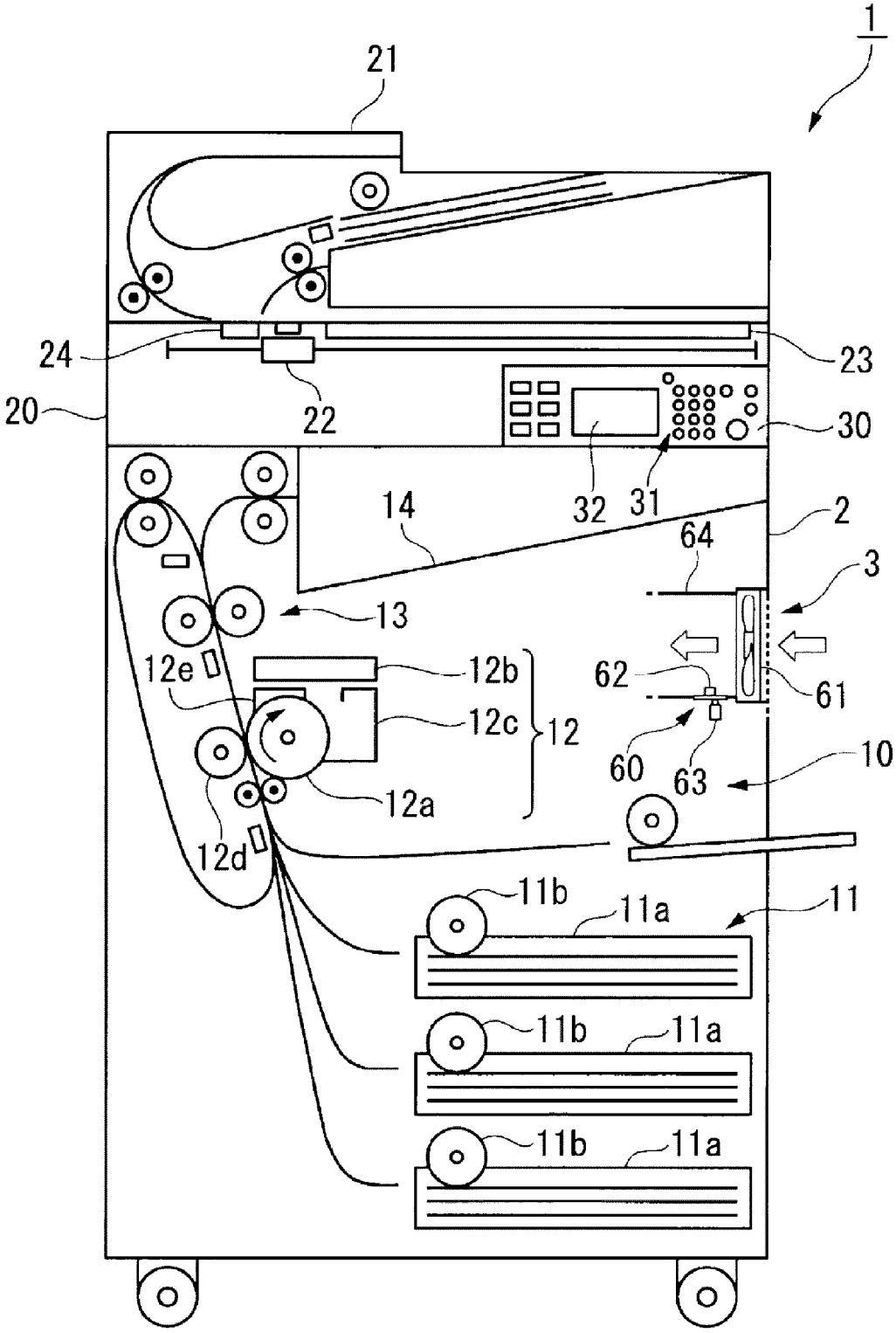
FIG. 1 is a schematic front view showing the structure and relevant components of a multifunction peripheral in one embodiment of the present disclosure.
Figure 2:
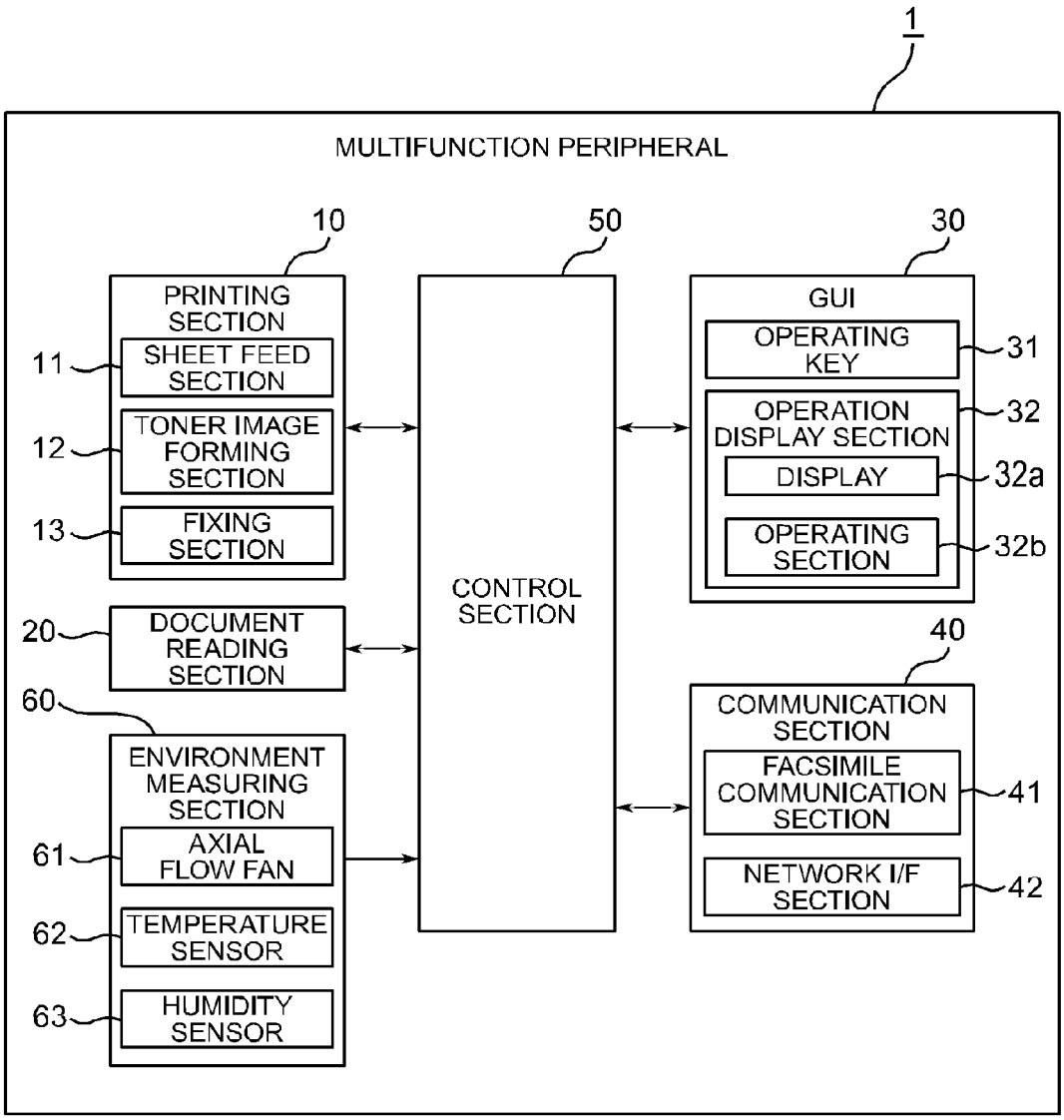
FIG. 2 is a functional block diagram of the multifunction peripheral in the one embodiment of the present disclosure.

FIG. 1 is a schematic front view showing the structure and relevant components of a multifunction peripheral 1 in one embodiment of the present disclosure. FIG. 2 is a functional block diagram of the multifunction peripheral 1 in the one embodiment of the present disclosure. As shown in these figures, the multifunction peripheral 1 includes a printing section 10, a document reading section 20, a GUI (graphical user interface) 30, a communication section 40, a control section (controller) 50, and an environment measuring section 60.

The printing section 10 is configured to, under the control of the control section 50, print an image on a print sheet and output the print sheet as a printed matter and includes a sheet feed section 11, a toner image forming section 12, a fixing section 13, a sheet output tray 14, and so on. The sheet feed section 11 includes a plurality of sheet feed cassettes 11*a* capable of containing a plurality (for example, dozens) of stacked standard-sized print sheets and capable of being pulled out of the multifunction peripheral 1 through the front surface thereof. The uppermost of the stacked print sheets contained in each of the sheet feed cassettes 11*a* can be picked up and conveyed toward the toner image forming section 12 by the drive of a pick-up roller 11*b*.

The toner image forming section 12 is configured to form on a print sheet a toner image corresponding to an image to be printed and includes a photosensitive drum 12*a*, an exposure section 12*b*, a developing section 12*c*, a transfer section 12*d*, a charging section 12*e*, and so on. The photosensitive drum 12*a* is a cylindrical photoconductor on which an electrostatic latent image corresponding to an image to be printed can be formed and a developed toner image can be carried. The exposure section 12*b* is configured to irradiate the surface of the photosensitive drum 12*a* with laser light for the formation of an electrostatic latent image.

The developing section 12*c* is configured to supply toner to the photosensitive drum 12*a* having an electrostatic latent image formed thereon, thereby developing the electrostatic latent image into a toner image. The transfer section 12*d* is configured to transfer the toner image carried on the photosensitive drum 12*a* to a print sheet conveyed from the sheet feed section 11. The charging section 12*e* is configured to apply a voltage to a contact charging member, such as a charging roller, in contact with the photosensitive drum 12*a* to charge the peripheral surface of the photosensitive drum 12*a* having undergone the transfer process with electricity again and thus allow the photosensitive drum 12*a* to be ready for the formation of a next electrostatic latent image to be done by the exposure section 12*b*.

The fixing section 13 is configured to apply heat and pressure to a toner image transferred to (formed on) a print sheet by the toner image forming section 12 to fix the toner image on the print sheet and then discharge (output) the print sheet having undergone the fixing process as a printed matter having a desired image printed thereon to the sheet output tray 14. The sheet output tray 14 is a portion on which printed matters output from the fixing section 13 are to be saved and is provided above the printing section 10.

The document reading section 20 is configured to, under the control of the control section 50, read an original document placed thereon by the user, generate document image data showing an image of the original document (document image), and output it to the control section 50 and includes an ADF (automatic document feeder) 21, a carriage 22, an original glass plate 23, a document read slit 24, and so on. The ADF 21 is a device configured to sequentially and automatically feed original documents to be read. The carriage 22 carries an exposure lamp, a CCD (charge coupled device) sensor, and so on and is configured to read original documents sequentially fed by the ADF 21 or an original document placed on the original glass plate 23.

Specifically, in reading an original document placed on the original glass plate 23, the carriage 22 reads the original document with the CCD sensor while moving in the longitudinal direction of the original glass plate 23. On the other hand, in reading original documents being sequentially fed from the ADF 21, the carriage 22 reads each of the original documents being sequentially fed from the ADF 21 with the CCD sensor through the document read slit 24 while staying at a position facing the document read slit 24 (position just below the document read slit 24).

The GUI 30 is configured to output a signal corresponding to a user's operation (an operation signal) to the control section 50 and display various kinds of information, such as information indicating the status of the multifunction peripheral 1, according to the control of the control section 50 and includes operating keys 31 and an operation display section 32. The operating keys 31 are hard keys, including a copy start key, a copy stop/clear key, a ten-key pad (numerical entry keys), and function selection keys. The function selection keys are keys used to, when the user uses each of the copy function, the print function, a scan function, and a facsimile function all of which can be implemented in the multifunction peripheral 1, switch the multifunction peripheral 1 to the operating mode for each function.

The operation display section 32 includes: a display 32*a* configured to, under the control of the control section 50, display a given image; and an operating section 32*b* configured to output to the control section 50 an operation signal corresponding to an operation done on a display screen of the display 32*a*. The display 32*a* is formed of, for example, a liquid crystal panel or an organic EL panel. The operating section 32*b* is formed of, for example, a touch panel disposed facing the display screen of the display 32*a* and configured to output as the operation signal a signal indicating the coordinate of a portion of the touch panel touched by the user.

The communication section 40 is configured to communicate with an external device, such as a destination facsimile machine or a personal computer, and includes a facsimile communication section 41 and a network I/F section 42. The facsimile communication section 41 is connected to a public phone line and configured to communicate with a destination facsimile machine. The network I/F section 42 is connected to, for example, a LAN (local area network) and configured to communicate with terminals, such as personal computers, likewise connected to the LAN.

The control section 50 takes overall control of the general operation of the multifunction peripheral 1 based on an operation signal entered through the GUI 30 or a signal received through the communication section 40 from an external device. Although will be described later in detail, the control section 50 also takes control of image formation based on detection results of at least one of a temperature sensor 62 and a humidity sensor 63 both provided in the environment measuring section 60. The control section 50 is composed of a CPU (central processing unit), a ROM (read only memory), a RAM (random access memory), an interface circuit operable to input and output signals from and to the aforementioned component elements, and so on.

The environment measuring section 60 includes an axial flow fan 61 operable to send external air to the interior of the apparatus body 2, the temperature sensor 62 disposed at a location directly exposed to air flow from the axial flow fan 61, and a humidity sensor 63 disposed at a location not directly exposed to the air flow from the axial flow fan 61. The environment measuring section 60 is configured to take external air into the interior of the apparatus body 2, send the air toward the toner image forming section 12 to cool it, and measure environmental values in the interior and outside of the apparatus body 2 based on changes in detection results due to the sending of the air.

Next, a detailed description will be given of the arrangement of the temperature sensor 62 and the humidity sensor 63 in the environment measuring section 60 with reference to FIG. 3.

Figure 3:
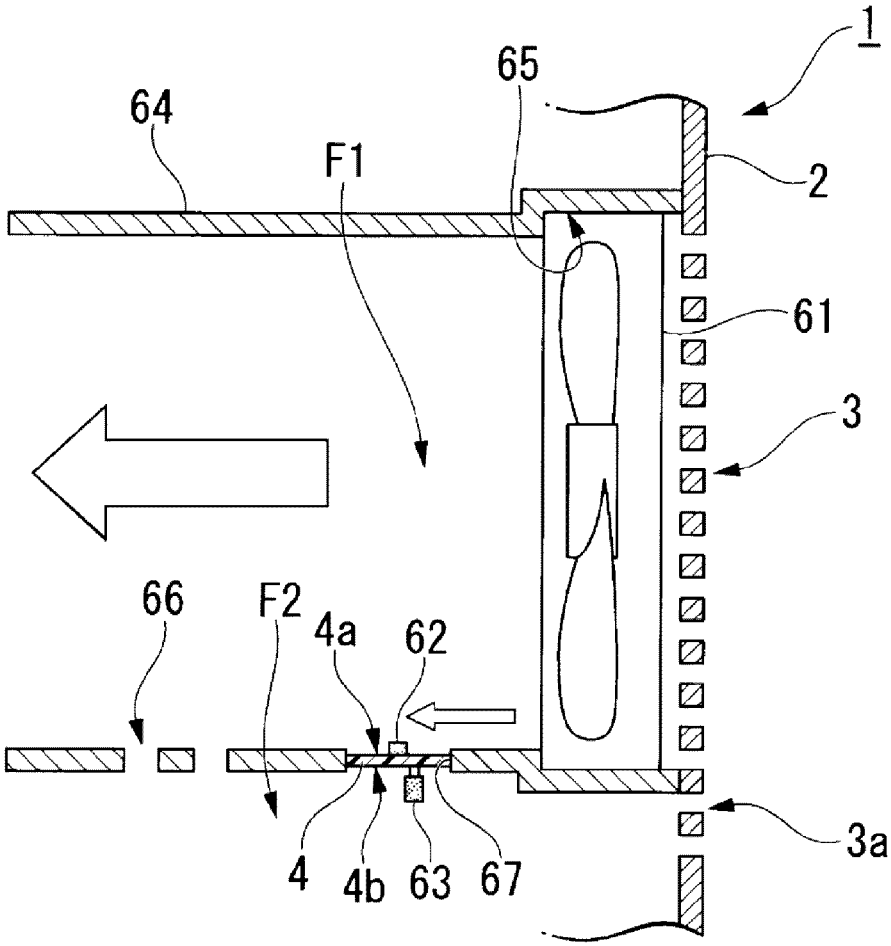
FIG. 3 is a view showing the arrangement of a temperature sensor and a humidity sensor in the one embodiment of the present disclosure.

FIG. 3 is a view showing the arrangement of the temperature sensor 62 and the humidity sensor 63 in the one embodiment of the present disclosure. As shown in this figure, the temperature sensor 62 and the humidity sensor 63 are disposed near the intake opening 3 formed in the apparatus body 2. The intake opening 3 is used to take in external air and, in this embodiment, is formed in a sidewall of the apparatus body 2. The intake opening 3 is equipped with a louver.

The axial flow fan 61 is configured to, under the control of the control section 50, send air through the intake opening 3 to the interior of the apparatus body 2 and provided behind the intake opening 3. The axial flow fan 61 is disposed next to the intake opening 3 and can take external air through the substantially entire region of the intake opening 3 into the interior of the apparatus body 2. Furthermore, the axial flow fan 61 does not face a lower end portion 3*a* of the intake opening 3 so that external air cannot be drawn in through the lower end portion 3*a* during activation of the axial flow fan 61.

The temperature sensor 62 and the humidity sensor 63 are provided on a common substrate 4. The temperature sensor 62 and the humidity sensor 63 are provided on both side surfaces of the substrate 4 with the substrate 4 between them. The temperature sensor 62 is an electronic component in chip form provided on one surface 4*a* of the substrate 4 and is configured to output detected results to the control section 50. The humidity sensor 63 is an electronic component standing on the other surface 4*b* of the substrate 4 and is configured to output detected results to the control section 50. The humidity sensor 63 in this embodiment is a humidity sensor of a type in which a polymer humidity-sensitive film capable of adsorbing water molecules in the surrounding environment is used as a dielectric and the humidity is detected from a change in capacitance between electrodes with the dielectric interposed therebetween.

The substrate 4 is disposed so that the one surface 4*a* with the temperature sensor 62 faces a first air flow path F1 formed by the activation of the axial flow fan 61. Furthermore, the substrate 4 is disposed so that the other surface 4*b* with the humidity sensor 63 faces a second air flow path F2 along which a smaller amount of air flow flows than along the first air flow path F1. In this embodiment, the one surface 4*a* of the substrate 4 is directly exposed to air flow from the axial flow fan 61 and the other surface 4*b* of the substrate 4 is not directly exposed to the air flow from the axial flow fan 61. Therefore, the amount of air flow along the second air flow path F2 is smaller than that along the first air flow path F1.

The first air flow path F1 is formed, by the activation of the axial flow fan 61, inside a duct 64 provided to allow air to flow through the intake opening 3, the axial flow fan 61, and the temperature sensor 62 in this order. On the other hand, the second air flow path F2 is formed outside the duct 64. The duct 64 extends from the intake opening 3 toward the toner image forming section 12. The duct 64 is provided, at an end next to the intake opening 3, with a fitting portion 65 configured to fit on the axial flow fan 61. The fitting portion 65 has an opening shape of a size that can support a back side edge of the axial flow fan 61 and fit on the axial flow fan 61.

In the interior of the duct 64, air flows, by the activation of the axial flow fan 61, through the intake opening 3, the axial flow fan 61, and the temperature sensor 62 in this order. The duct 64 is provided with a communication hole 66 which communicates the first air flow path F1 formed inside the duct 64 with the second air flow path F2 formed outside the duct 64. The communication hole 66 is provided in the first air flow path F1 downstream of the temperature sensor 62. The communication hole 66 has a sufficiently smaller size than the opening of the duct 64 so that the amount of air flow leaking through the communication hole 66 into the second air flow path F2 becomes sufficiently small relative to the amount of air flow along the first air flow path F1 formed by the activation of the axial flow fan 61.

The substrate 4 including the temperature sensor 62 and the humidity sensor 63 forms a portion of the duct 64. Specifically, an opening 67 is formed in the duct 64 and the substrate 4 is attached to the duct 64 to block the opening 67. The substrate 4 is attached in a position parallel with the direction of air flow along the first air flow path F1 formed by the activation of the axial flow fan 61. Since the substrate 4 forms a portion of the duct 64, the one surface 4*a* thereof faces the interior of the duct 64 and the other surface 4*b* thereof faces the outside of the duct 64. Therefore, the temperature sensor 62 placed on the one surface 4*a* of the substrate 4 is exposed to the first air flow path F1, while the humidity sensor 63 placed on the other surface 4*b* of the substrate 4 is exposed to the second air flow path F2.

The first air flow path F1 and the second air flow path F2 are communicated individually and independently with the intake opening 3. The first air flow path F1 is communicated through the duct 64 with the intake opening 3. On the other hand, the second air flow path F2 is communicated with the lower end portion 3*a* of the intake opening 3. The lower end portion 3*a* of the intake opening 3 does not face the duct 64 and is configured to take external air directly into the interior of the apparatus body 2.

Therefore, the first air flow path F1 and the second air flow path F2 are connected, in parallel with each other, to the intake opening 3, so that external air can be introduced through the intake opening 3 into these two air flow paths.

A description will be given below of an operation of the multifunction peripheral 1 configured as above.

Figure 4:
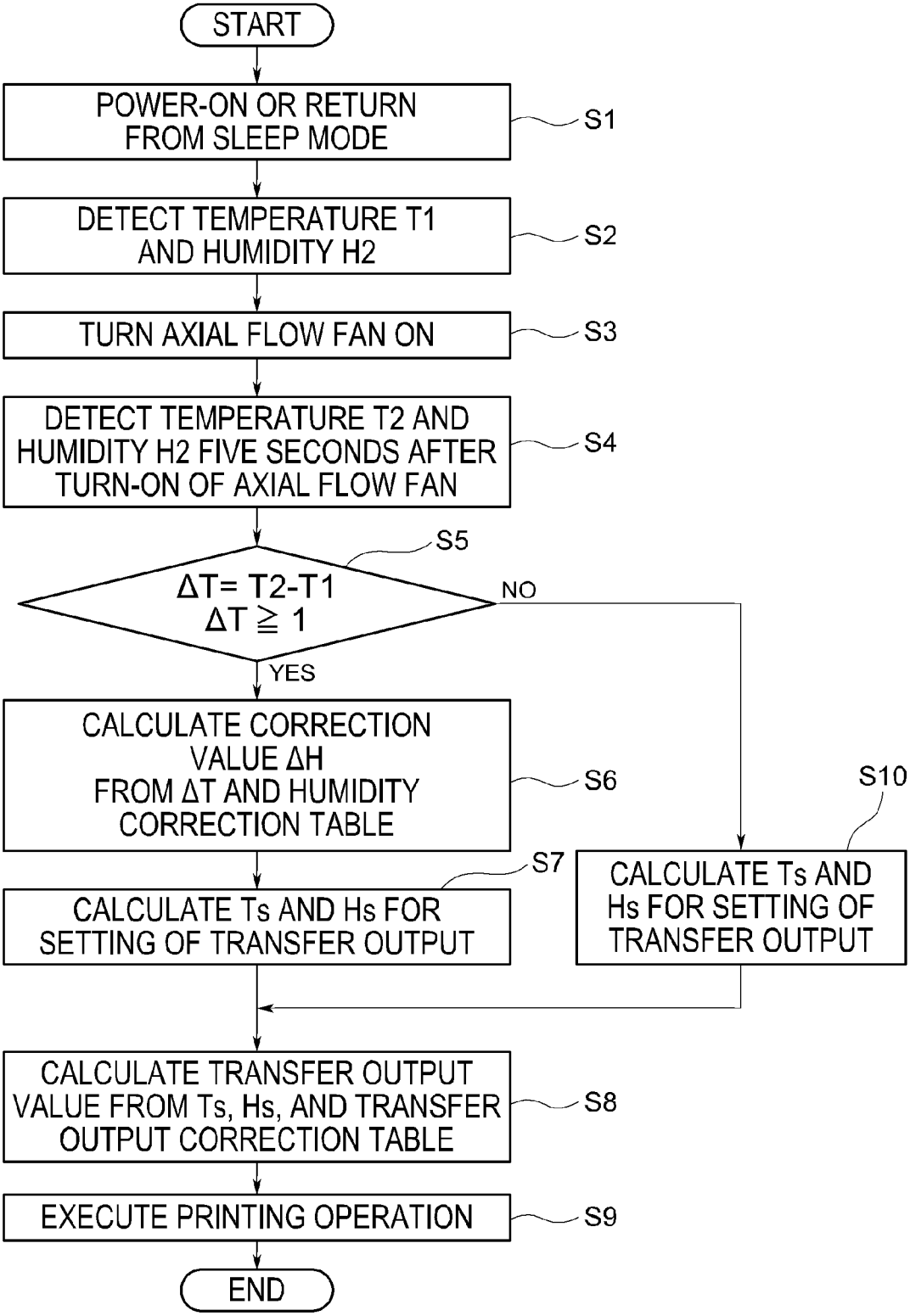
FIG. 4 is a flowchart showing an operation of the multifunction peripheral (a sequence of control taken by a control section to correct the transfer output based on detected values of the temperature sensor and the humidity sensor, i.e., a sequence of control of image formation) in the one embodiment of the present disclosure.

FIG. 4 is a flowchart showing an operation of the multifunction peripheral 1 (to be precise, a sequence of control taken by the control section 50 to correct the transfer output based on detected values of the temperature sensor 62 and the humidity sensor 63, i.e., a sequence of control of image formation) in the one embodiment of the present disclosure. FIG. 5 is a correction table showing humidity correction values ($\Delta h$) versus temperature change ($\Delta T$) in the one embodiment of the present disclosure. FIG. 6 is a correction table showing transfer output values versus temperature (Ts) and humidity (Hs) in the one embodiment of the present disclosure.

As shown in FIG. 4, when a power button is turned on or the multifunction peripheral 1 is returned from a sleep mode to a normal operation mode, such as by the operation of the GUI 30, the operation of the multifunction peripheral 1 is started (step S1).

In the next step S2, the temperature (T1) and humidity (H2) at the start of the operation are detected. The temperature (T1) is detected by the temperature sensor 62, while the humidity (H2) is detected by the humidity sensor 63. In step S2, because the axial flow fan 61 shown in FIG. 3 has not yet been activated, the temperature (T1) detected in this step is the internal temperature of the apparatus body 2.

The humidity (H2) detected in this step is the internal humidity of the apparatus body 2. However, since the second air flow path F2 is communicated directly with the lower end portion 3*a* of the intake opening 3 and the humidity sensor 63 is disposed near the lower end portion 3*a*, the humidity (H2) detected is approximately equal to the humidity outside the apparatus body 2.

In the next step S3, the axial flow fan 61 is started to be activated, so that external air is taken through the intake opening 3 into the interior of the apparatus body 2.

In the next step S4, the temperature (T2) and humidity (H2) five seconds after the start of activation of the axial flow fan 61 are detected. The temperature (T2) is detected by the temperature sensor 62, while the humidity (H2) is detected by the humidity sensor 63. The humidity detected in step S4 is approximately equal to the humidity (H2) detected in step S2. Since, as described previously, the humidity (H2) detected in step S2 is approximately equal to the humidity outside the apparatus body 2, the value of humidity hardly changes even after external air is gradually introduced into the apparatus body 2 and circulated through the communication hole 66 by the activation of the axial flow fan 61.

When the axial flow fan 61 shown in FIG. 3 is activated, the first air flow path F1 is formed along which air flows through the intake opening 3, the axial flow fan 61, and the temperature sensor 62 in this order. In this embodiment, the temperature sensor 62 and the humidity sensor 63 are provided on different surfaces of the substrate 4 and the temperature sensor 62 is disposed facing the first air flow path F1 in which the amount of air flow formed by the activation of the axial flow fan 61 is large. Therefore, the temperature sensor 62 is exposed directly to external air by the activation of the axial flow fan 61 and virtually detects the temperature outside the apparatus body 2.

In the next step S5, the temperature change (ΔT) five seconds after the start of activation of the axial flow fan 61 is obtained and it is determined whether or not ΔT is equal to or larger than 1° C. If "YES" in step S5, the operation proceeds to step S6. On the other hand, if "NO" in step S5, that is, when the temperature difference between the interior and outside of the apparatus body 2 is very small, the operation proceeds to step S10, in which the temperature (Ts) and humidity (Hs) for setting the transfer output are calculated. In step S10, the temperature (Ts) and the humidity (Hs) are set at the temperature (T2) and the humidity (H2), respectively, as they are.

When the operation proceeds to step S6, the humidity correction table shown in FIG. 5 is used to calculate a humidity correction value (Δh) from the temperature change (ΔT).

In the next step S7, the temperature (Ts) and humidity (Hs) for setting the transfer output are calculated. In step S7, the temperature (Ts) is set at the temperature (T2). On the other hand, the humidity (Hs), in step S7, is set at a value obtained by adding to the humidity (H2) the humidity correction value (Δh) calculated in step S6.

In the next step S8, the transfer output correction table shown in FIG. 6 is used to calculate a transfer output correction value from the temperature (Ts) and humidity (Hs) calculated in step S7 or S10.

Then, in step S9, a printing operation is executed using the transfer output correction value calculated in step S8.

The description thus far is given of the operation of the multifunction peripheral 1 in the one embodiment of the present disclosure. In a general image forming apparatus, external air is introduced thereinto via a fan or the like for the purpose of cooling the image forming section and the temperature and humidity sensors are exposed to the external air having passed through the fan or the like to increase the response of the detected values. However, such a general image forming apparatus may cause problems when changes in the environment around the apparatus are rapid. For example, if the apparatus is left under low-temperature conditions for a long time in winter night and then undergoes a rapid change in the surrounding environment due to room heating in the morning, i.e., if high-temperature external air is introduced into the low-temperature interior of the apparatus by the activation of the fan, dew condensation may occur on the humidity sensor exposed directly to the external air. Widely-used, common, inexpensive humidity sensors are susceptible to dew condensation and, particularly, polymer humidity sensors are very likely to deteriorate the polymer humidity-sensitive film owing to dew condensation and thus may result in reduced precision or failure.

Also in the multifunction peripheral 1 according to the one embodiment of the present disclosure, at the time of activation of the axial flow fan 61 in step S3 in the above sequence operation, there may be a large temperature difference between the interior and outside of the apparatus body 2. In this embodiment, as shown in FIG. 3, the humidity sensor 63 is disposed facing the second air flow path F2 along which a smaller amount of air flow flows than along the first air flow path F1. Therefore, even when the axial flow fan 61 is activated, the humidity sensor 63 is not directly exposed to the air outside the apparatus body 2, which prevents the occurrence of dew condensation due to a rapid temperature change. Hence, even with the use of the inexpensive humidity sensor 63 including a polymer humidity-sensitive film, neither reduction in precision nor failure occurs, which contributes to cost reduction.

Furthermore, in this embodiment, the temperature sensor 62 is disposed facing the first air flow path F1 in which the amount of air flow formed by the activation of the axial flow fan 61 is large. Therefore, the temperature sensor 62 is exposed directly to external air by the activation of the axial flow fan 61, so that the response of temperature detection can be maintained. Hence, in the multifunction peripheral 1 of this embodiment, the risk of deterioration of the humidity sensor due to dew condensation can be avoided while the response of detection of the external environment can be maintained.

Moreover, in this embodiment, the first air flow path F1 is formed, by the activation of the axial flow fan 61, inside the duct 64 provided to allow air to flow through the intake opening 3, the axial flow fan 61, and the temperature sensor 62 in this order and the second air flow path F2 is formed outside the duct 64. Thus, the temperature sensor 62 disposed in the interior of the duct 64 can be exposed directly to external air taken in through the intake opening 3 and the axial flow fan 61, while the humidity sensor 63 disposed outside the duct 64 can be hardly influenced by the axial flow fan 61. In addition, since the substrate 4 in this embodiment forms a portion of the duct 64, there is no need to additionally provide any structure for holding the substrate 4, which contributes to parts count reduction and cost reduction.

Furthermore, in this embodiment, the sidewall of the duct 64 is provided with a communication hole 66 which communicates the first air flow path F1 with the second air flow path F2. The communication hole 66 is formed to have a smaller size than the opening of the duct 64. Thus, the amount of air flow leaking through the communication hole 66 into the second air flow path F2 can be sufficiently small relative to the amount of air flow along the first air flow path F1 formed by the activation of the axial flow fan 61.

In this embodiment, since the first air flow path F1 and the second air flow path F2 are communicated individually and independently with the intake opening 3, not only the first air flow path F1 with the temperature sensor 62 disposed therein but also the second air flow path F2 with the humidity sensor 63 disposed therein are connected to the intake opening 3. Therefore, external air can be directly taken in also along the second air flow path F2, so that the detection response of the humidity sensor 63 can be maintained. Hence, in this embodiment, the temperature and humidity can be detected with high responsiveness and the control according to the detection results can be implemented, resulting in increased image quality.

As thus far described, this embodiment is configured to include: an apparatus body 2 having an intake opening 3 formed therein to take in external air; an axial flow fan 61 configured to send air through the intake opening 3 to the interior of the apparatus body 2; and a substrate 4 in which one surface 4*a* facing a first air flow path F1 formed by the activation of the axial flow fan 61 is provided with a temperature sensor 62 and the other surface 4*b* facing a second air flow path F2 having a smaller amount of air flow than the first air flow path F1 is provided with a humidity sensor 63. Therefore, a multifunction peripheral 1 can be obtained in which the humidity sensor 63 can be prevented from deterioration due to dew condensation while the response of detection of temperature and humidity in the external environment can be maintained.

Furthermore, in this embodiment, the multifunction peripheral 1 includes the control section 50 (controller) configured to take control of image formation based on detection results of at least one of the temperature sensor 62 and the humidity sensor 63. Thus, the multifunction peripheral 1 can detect the temperature and humidity with high responsiveness and implement the control according to the detection results, resulting in increased image quality.

Although a preferred embodiment of the present disclosure has thus far been described with reference to the drawings, the contents of the present disclosure are not limited to the above embodiment. The shapes, combination, and so on of component elements shown in the above embodiment are illustrative only and various modifications can be made to them based on design and other needs without departing from the spirit and scope of the present disclosure.

For example, in the above embodiment, the control of image formation taken by the control section 50 based on detection results of the temperature sensor 62 and the humidity sensor 63 is configured to correct the transfer output. However, the contents of the present disclosure are not limited to this configuration and the control of image formation may be implemented as shown in FIG. 7.

Figure 7:
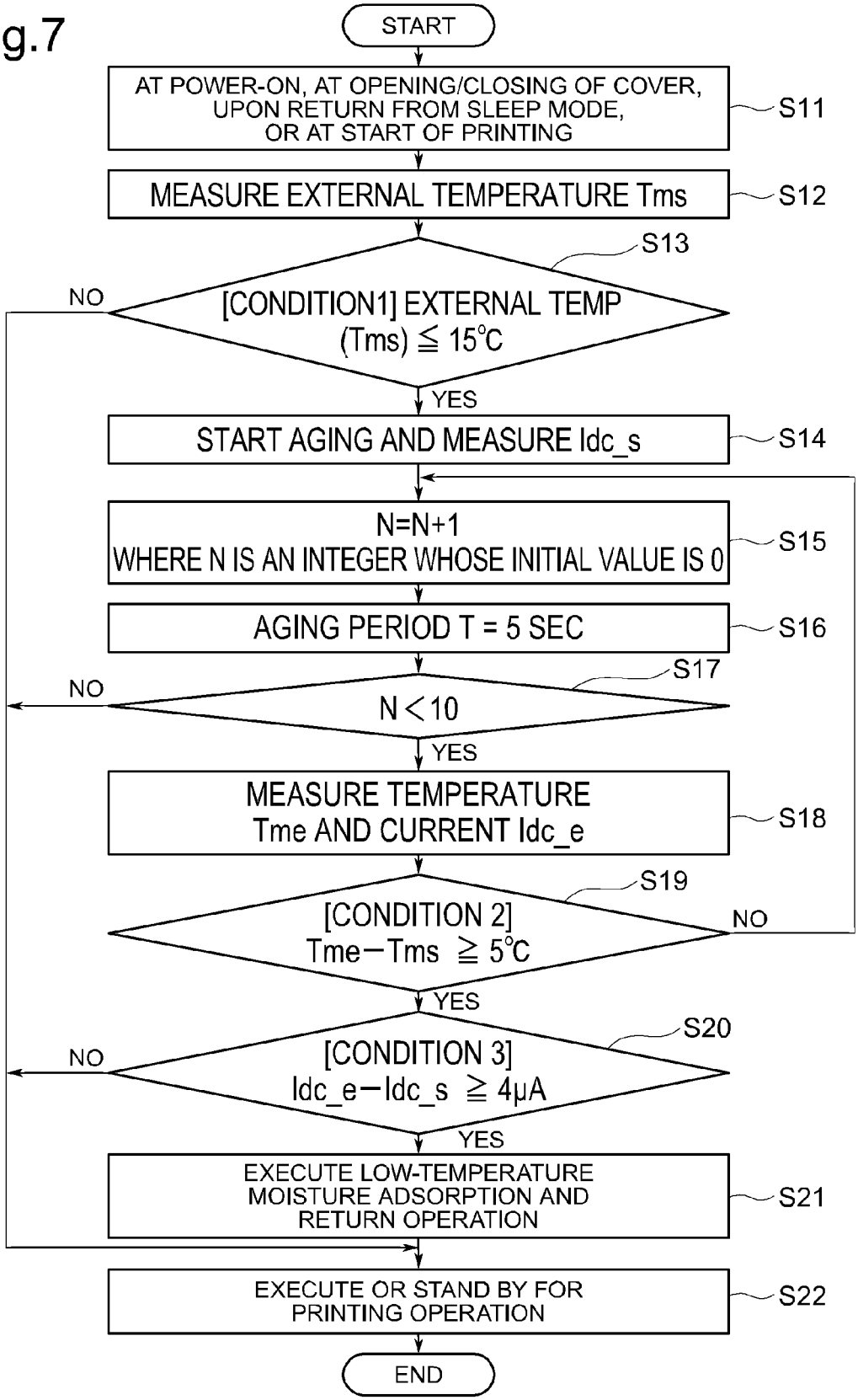
FIG. 7 is a flowchart showing an operation of the multifunction peripheral (a sequence of control taken by the control section to transition to a dew condensation elimination mode based on a detected value of the temperature sensor, i.e., a sequence of control of image formation) in another embodiment of the present disclosure.

FIG. 7 is a flowchart showing an operation of the multifunction peripheral 1 (a sequence of control taken by the control section 50 to transition to a dew condensation elimination mode based on a detected value of the temperature sensor 62, i.e., a sequence of control of image formation) in another embodiment of the present disclosure.

As shown in FIG. 7, the operation is started at power-on, at the opening/closing of the cover, upon return from the sleep mode, or at the start of printing (step S11).

In the next step S12, the external temperature (Tms) at the start of the operation is measured. The external temperature (Tms) is detected by the temperature sensor 62.

In the next step S13, it is determined whether or not the external temperature (Tms) is equal to or lower than 15° C. If "YES" in step S13, i.e., if the external temperature is a low temperature likely to cause dew condensation, the operation proceeds to step S14. On the other hand, if "NO" in step S13, the operation proceeds to step S22, in which the apparatus implements a printing operation or stands by for receiving a command to execute a printing operation.

When the operation proceeds to step S14, aging is started and the charging current (Idc_s) of the charging section 12*e* is measured by an unshown electric current sensor. Aging refers to the operation of idling the drive system (including the photosensitive drum 12*a* and the conveyance roller) of the multifunction peripheral 1 shown in FIG. 1.

In the next step S15, the number (N) of aging times is counted up.

In the next step S16, the aging is implemented for five seconds.

In the next step S17, it is determined whether or not the number (N) of aging times is less than ten. If "YES" in step S17, the operation proceeds to step S18. On the other hand, if "NO" in step S17, the interior of the apparatus body 2 has already sufficiently been warmed by ten times of aging. Therefore, the operation proceeds to step S22, in which the apparatus implements a printing operation or stands by for receiving a command to execute a printing operation.

When the operation proceeds to step S18, the temperature (Tme) after aging is measured and the charging current (Idc_e) after aging is measured.

In the next step S19, it is determined whether or not the difference between the temperature (Tme) after aging and the external temperature (Tms) is equal to or larger than 5° C. If "YES" in step S19, the operation proceeds to step S20. On the other hand, if "NO" in step S19, i.e., if the interior of the apparatus body 2 has not yet sufficiently been warmed by aging, the operation goes back to step S15, in which the number (N) of aging times is counted up and aging is continued.

In the next step S20, it is determined whether or not the difference between the charging current (Idc_e) after aging and the charging current (Idc_s) is equal to or larger than 4 μA. If "YES" in step S20, the operation proceeds to step S21. On the other hand, if "NO" in step S20, i.e., if there is no problem with the change in charging current due to aging, the operation proceeds to step S22, in which the apparatus implements a printing operation or stands by for receiving a command to execute a printing operation.

When the operation proceeds to step S21, a low-temperature moisture adsorption and return operation is executed. If dew condensation occurs in the toner image forming section 12, the organic photoconductor of the photosensitive drum 12*a* may be locally electrically broken down by the application of a charge of the charging section 12*e*. Therefore, the value of current flowing into the charging roller of the charging section 12*e* is measured and whether or not dew condensation has occurred is detected from the change in the charging current applied to the photosensitive drum 12*a*. The low-temperature moisture adsorption and return operation is an operation for supplying toner from the developing section 12*c* to the entire peripheral surface of the photosensitive drum 12*a* and recovering the toner together with water drops condensed on the peripheral surface of the photosensitive drum 12*a* by an unshown toner cleaning section.

After the low-temperature moisture adsorption and return operation is executed, the sequence proceeds to step S22, in which the apparatus implements a printing operation or stands by for receiving a command to execute a printing operation.

With the above multifunction peripheral 1 of the other embodiment of the present disclosure, the humidity sensor 63 can be prevented from deteriorating owing to dew condensation, while the response of detection of temperature and humidity in the external environment can be maintained. In addition, the photoconductor can be prevented from being broken down owing to leak of charging current caused by dew condensation due to significant temperature and humidity differences between the interior and outside of the apparatus body 2.

Figure 8:
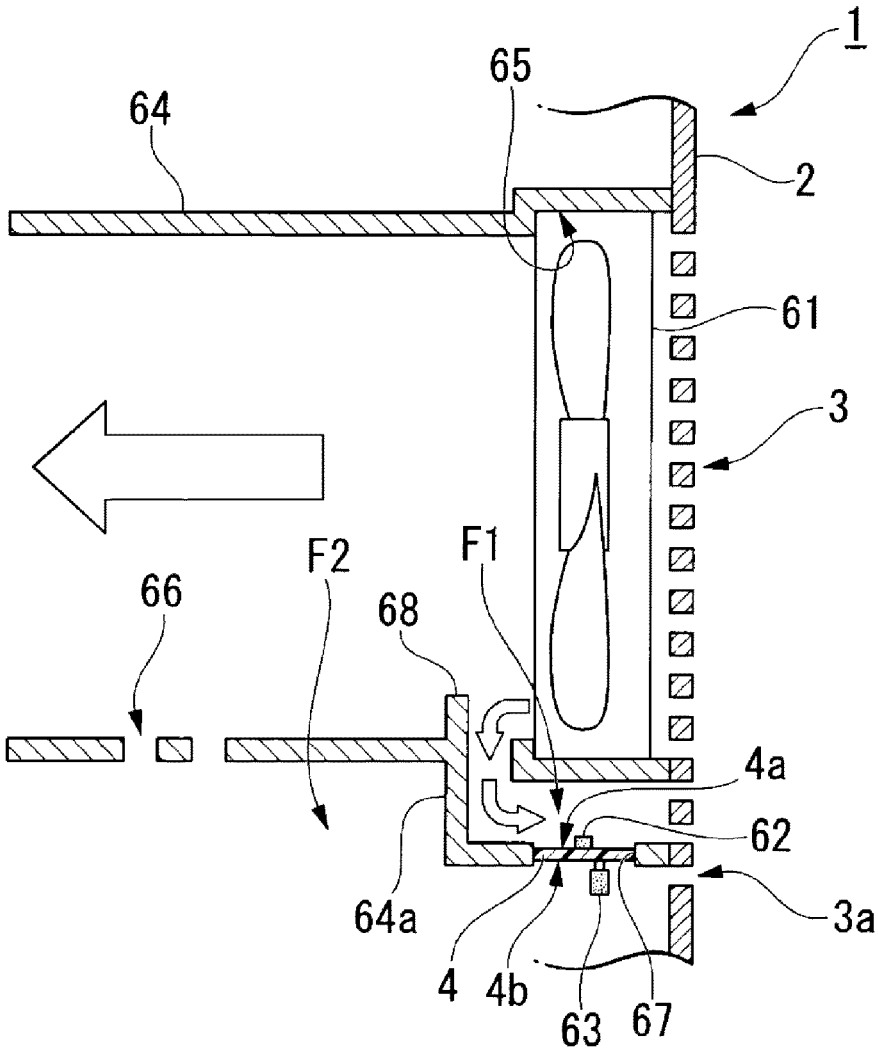
FIG. 8 is a view showing the arrangement of a temperature sensor and a humidity sensor in still another embodiment of the present disclosure.

Although in the above embodiments the temperature sensor 62 and the humidity sensor 63 are arranged as shown in FIG. 3, the contents of the present disclosure are not limited to this arrangement and, for example, the temperature sensor 62 and the humidity sensor 63 may be arranged as shown in FIG. 8.

FIG. 8 is a view showing the arrangement of the temperature sensor 62 and the humidity sensor 63 in still another embodiment of the present disclosure.

As shown in FIG. 8, the substrate 4 is disposed so that the one surface 4*a* with the temperature sensor 62 faces a first air flow path F1 formed by the activation of the axial flow fan 61. Furthermore, the substrate 4 is disposed so that the other surface 4*b* with the humidity sensor 63 faces a second air flow path F2 along which a smaller amount of air flow flows than along the first air flow path F1. In this embodiment, the first air flow path F1 is formed inside a branch duct 64*a*. The branch duct 64*a* is located downstream of the axial flow fan 61, branched off from the main channel of the duct 64 upstream of the communication hole 66, and communicated at the terminal end thereof with the intake opening 3.

Provided at the branching point on the inside surface of the duct 64 is a guide portion 68 configured to guide air flow from the axial flow fan 61 to the branch duct 64*a*. The guide portion 68 has a plate-like shape standing perpendicularly to the main channel of the duct 64.

With the multifunction peripheral 1 of the above embodiment, the humidity sensor 63 can be prevented from deteriorating owing to dew condensation, while the response of detection of temperature and humidity in the external environment can be maintained. In addition, since the substrate 4 is located close to the intake opening 3, the response of detection of temperature and humidity can be further increased.

Although in the above embodiments a multifunction peripheral has been described as an example of the image forming apparatus according to the present disclosure, the present disclosure is also applicable to other types of image forming apparatuses, including, for example, a copier, a printer, and a facsimile machine.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. An image forming apparatus comprising:

an apparatus body including an intake opening through which external air is taken in;

a blower configured to send air through the intake opening to an interior of the apparatus body; and a substrate including a temperature sensor placed on one surface thereof facing a first air flow path formed by activation of the blower and a humidity sensor placed on the other surface thereof facing a second air flow path along which a smaller amount of air flow flows than along the first air flow path, wherein the first air flow path is formed, by the activation of the blower, inside a duct provided to allow air to flow through the intake opening, the blower, and the temperature sensor in this order, the second air flow path is formed outside the duct, a sidewall of the duct is provided with a communication hole which communicates the first air flow path with the second air flow path, and the communication hole is formed to have a smaller size than an opening of the duct.

2. The image forming apparatus according to claim 1, further comprising a controller configured to take control of image formation based on detection results of at least one of the temperature sensor and the humidity sensor.

3. The image forming apparatus according to claim 1, wherein the substrate forms a portion of the duct.

4. The image forming apparatus according to claim 1, wherein the first air flow path and the second air flow path are communicated individually and independently with the intake opening.

5. The image forming apparatus according to claim 1, wherein the humidity sensor includes a polymer humidity-sensitive film.

6. An image forming apparatus comprising:

an apparatus body including an intake opening through which external air is taken in;

a blower configured to send air through the intake opening to an interior of the apparatus body; and a substrate including a temperature sensor placed on one surface thereof facing a first air flow path formed by activation of the blower and a humidity sensor placed on the other surface thereof facing a second air flow path along which a smaller amount of air flow flows than along the first air flow path, wherein the first air flow path and the second air flow path are communicated individually and independently with the intake opening.

7. The image forming apparatus according to claim 5, wherein the first air flow path is formed, by the activation of the blower, inside a duct provided to allow air to flow through the intake opening, the blower, and the temperature sensor in this order, and the second air flow path is formed outside the duct.

8. The image forming apparatus according to claim 7, wherein the substrate forms a portion of the duct.

9. The image forming apparatus according to claim 6, wherein a sidewall of the duct is provided with a communication hole which communicates the first air flow path with the second air flow path, and the communication hole is formed to have a smaller size than an opening of the duct.

10. The image forming apparatus according to claim 6, wherein the humidity sensor includes a polymer humidity-sensitive film.

11. The image forming apparatus according to claim 6, further comprising a controller configured to take control of image formation based on detection results of at least one of the temperature sensor and the humidity sensor.

12. An image forming apparatus comprising:

an apparatus body including an intake opening through which external air is taken in;

a blower configured to send air through the intake opening to an interior of the apparatus body; and a substrate including a temperature sensor placed on one surface thereof facing a first air flow path formed by activation of the blower and a humidity sensor placed on the other surface thereof facing a second air flow path along which a smaller amount of air flow flows than along the first air flow path, wherein the humidity sensor includes a polymer humidity-sensitive film.

13. The image forming apparatus according to claim 12, wherein the first air flow path is formed, by the activation of the blower, inside a duct provided to allow air to flow through the intake opening, the blower, and the temperature sensor in this order, and the second air flow path is formed outside the duct.

14. The image forming apparatus according to claim 13, wherein the substrate forms a portion of the duct.

15. The image forming apparatus according to claim 12, wherein a sidewall of the duct is provided with a communication hole which communicates the first air flow path with the second air flow path, and the communication hole is formed to have a smaller size than an opening of the duct.

16. The image forming apparatus according to claim 12, wherein the first air flow path and the second air flow path are communicated individually and independently with the intake opening.

17. The image forming apparatus according to claim 12, further comprising a controller configured to take control of image formation based on detection results of at least one of the temperature sensor and the humidity sensor.

* * * * *